US008424882B2

(12) United States Patent
Visinski et al.

(10) Patent No.: US 8,424,882 B2
(45) Date of Patent: Apr. 23, 2013

(54) SKATEBOARD TRUCK

(75) Inventors: Andrew M. Visinski, Shelton, CT (US); Josef F. Visinski, Shelton, CT (US)

(73) Assignee: Surf-Rodz LLC, Seymour, CT (US)

( * ) Notice: Subject to any disclaimer, the term of this patent is extended or adjusted under 35 U.S.C. 154(b) by 140 days.

(21) Appl. No.: 12/972,838

(22) Filed: Dec. 20, 2010

(65) Prior Publication Data

US 2011/0148055 A1 Jun. 23, 2011

Related U.S. Application Data

(60) Provisional application No. 61/284,439, filed on Dec. 18, 2009.

(51) Int. Cl.
*A63C 3/14* (2006.01)
*A63C 17/02* (2006.01)
*A63C 1/22* (2006.01)

(52) U.S. Cl.
USPC ..... 280/11.27; 280/11.28; 280/87.042

(58) Field of Classification Search ..... 280/11.27, 280/11.28, 87.041, 87.042, 11.19, 842
See application file for complete search history.

(56) References Cited

U.S. PATENT DOCUMENTS 2,233,355 A * 2/1941 Ware ..... 280/11.28
2,719,723 A * 10/1955 Ware ..... 280/11.209
4,047,725 A * 9/1977 Pinchock ..... 280/11.28
4,071,256 A * 1/1978 Kimmell ..... 280/11.28
4,194,752 A * 3/1980 Tilch et al. ..... 280/11.28
5,478,095 A * 12/1995 Marandel ..... 280/11.28
5,879,013 A * 3/1999 Shih ..... 280/11.28
6,315,304 B1 * 11/2001 Kirkland et al. ..... 280/11.28
6,315,312 B1 * 11/2001 Reyes et al. ..... 280/87.042
6,367,819 B1 * 4/2002 Andersen et al. ..... 280/11.28
6,428,023 B2 * 8/2002 Reyes et al. ..... 280/87.042
6,474,666 B1 * 11/2002 Andersen et al. ..... 280/87.041
6,523,837 B2 * 2/2003 Kirkland ..... 280/11.28
7,093,842 B2 * 8/2006 Chmelar ..... 280/87.042
7,341,260 B1 * 3/2008 Hosoda et al. ..... 280/11.19
7,984,917 B2 * 7/2011 Lake et al. ..... 280/87.042
2004/0145142 A1 * 7/2004 Wang ..... 280/87.042
2006/0097470 A1 * 5/2006 Chmelar ..... 280/87.042
2009/0256324 A1 * 10/2009 Lake et al. ..... 280/87.042
2011/0210526 A1 * 9/2011 Williams, Jr. ..... 280/11.28
2012/0068428 A1 * 3/2012 Visinski et al. ..... 280/87.042

* cited by examiner

*Primary Examiner* — J. Allen Shriver, II
*Assistant Examiner* — Andrew Khouzam
(74) *Attorney, Agent, or Firm* — Ware, Fressola, Maguire & Barber LLP

(57) ABSTRACT

A truck according to the present invention includes a hanger dimensioned for insertion of axles upon which wheels are attached. The truck may be configured for attachment to a skateboard. The hanger includes a cutout portion including a key cavity into which a key is positioned. Bushings and a kingpin are also installed onto the hanger. The key when positioned within the key cavity of the hanger confines the pivot of the hanger on a centerline which bisects the hanger. The key may include extending cylindrical tabs which may allow for the hanger to freely swivel about the kingpin passing therethrough without the use of bearing surfaces. The bushings are positioned on the kingpin and on opposite sides of the key and key cavity of the hanger so as to urge the hanger to its center position.

12 Claims, 6 Drawing Sheets

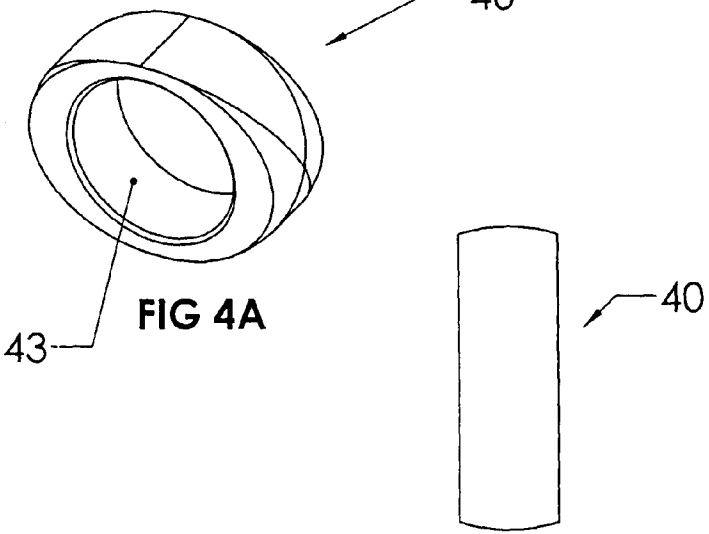
FIG 4A
FIG 5
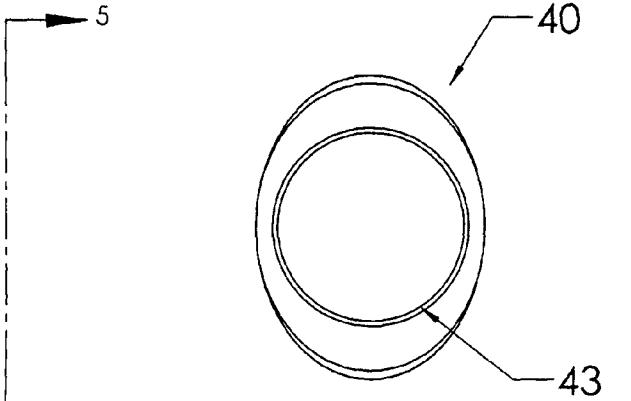
FIG 4
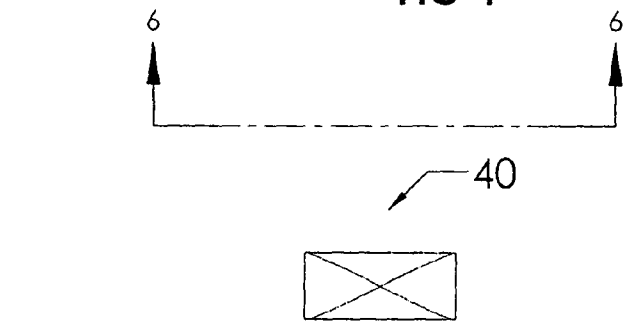
FIG 6

SKATEBOARD TRUCK

CROSS REFERENCE TO RELATED APPLICATIONS

This application claims priority to U.S. Provisional Appl. No. 61/284,439 filed Dec. 18, 2010, which is hereby incorporated by reference in its entirety.

TECHNICAL FIELD

This invention relates to a skateboard truck used on skateboards and the like.

BACKGROUND OF THE INVENTION

Skateboards include a steering mechanism known as trucks. Trucks are mounted on the underside of a skateboard deck, one in the front and one in the rear. Each truck has a pair of wheels attached thereto at respective ends of an axle of the truck. The truck provides support of the wheels, as well as the steering mechanism for the wheels depending upon the pressure exerted to the top of the skateboard deck. Skateboards have traditionally used spherical bearings in the center of the truck. A spherical bearing is a bearing that permits angular rotation about a central point in two orthogonal directions which are usually within a specified angular limit based on the bearing geometry. Typically, such bearings support a rotating shaft in a bore of the inner ring that must move not only rotationally, but also at an angle. The issue with such spherical bearings is that they do not support a bushing. That is, the spherical bearing's only function is to co-operate with a kingpin so that there is minimal slop in movement. Therefore, there is a need to allow cooperation with all of the parts of the truck so as to provide a smooth swivel movement of the truck; thereby allowing the bushings to perform and interact quickly.

SUMMARY OF THE INVENTION

A truck according to the present invention includes a hanger dimensioned for insertion of axles upon which wheels are attached. The hanger includes a cutout portion including a key cavity into which a key is positioned. Bushings and a kingpin are also installed onto the hanger. The key when positioned within the key cavity of the hanger confines the pivot of the hanger on a centerline which bisects the hanger. The key may include extending cylindrical tabs which may allow for the hanger to freely swivel about the kingpin passing therethrough without the use of bearing surfaces. The bushings are positioned on the kingpin and on opposite sides of the key and key cavity of the hanger so as to urge the hanger to its center position.

An exemplary embodiment of the present invention is directed to a truck configured for attachment to a skateboard. The truck may include a hanger, and a pair of arms extending from the hanger and positioned on opposite sides of a centerline that bisects the hanger. The hanger may also include a first cutout portion on a first side of the hanger, and a second cutout portion on a second side of the hanger. A key cavity may extend through the hanger from the first cutout portion to the second cutout portion, and the key cavity may be dimensioned for receipt of a key. The first cutout portion may be dimensioned for receipt of a first bushing, and the second cutout portion is dimensioned for receipt of a second bushing.

According to the exemplary embodiment of the invention, the key may include a central bore, and the key may be configured to permit the truck to pivot on the centerline when the key is inserted into the key cavity and a kingpin is passed through the central bore of the key.

According to the exemplary embodiment of the invention, the first bushing, the key and the second bushing may be configured to be held together on the hanger by a kingpin, and the kingpin may be configured to connect the truck to the skateboard.

According to the exemplary embodiment of the invention, the hanger may be configured to position the first bushing and second bushing on opposite sides of the key so that the key is held in place by the first bushing and the second bushing.

According to the exemplary embodiment of the invention, the key may also include a central bore, and the first bushing, second bushing and key may be secured to the hanger by a kingpin inserted at least through the central bore of the key.

According to the exemplary embodiment of the invention, the truck may also include a pivot pin section comprising a substantially cylindrical section extending from the hanger, and a substantially hemispherical section extending from the cylindrical section.

According to the exemplary embodiment of the invention, each arm of the pair of arms may also include a bore forming a cavity dimensioned for receipt of an axle configured to attach a wheel to the truck.

According to the exemplary embodiment of the invention, the key may also include at least one cylindrical shaped tab, and the key cavity may include at least one semi-cylindrical cutout region dimensioned for receipt of the at least one cylindrical shaped tab of the key.

According to the exemplary embodiment of the invention, the skateboard may include a deck, a pair of baseplates, a pair of support members attached to an underside of the deck and to a corresponding one of the baseplates, and the truck may be configured for attachment to one of the baseplates.

BRIEF DESCRIPTION OF THE DRAWINGS

FIG. 4 is a plan view of an exemplary embodiment of a key according to the present invention.

FIG. 4A is a perspective view of the key shown in FIG. 4.

FIG. 5 is a side view of the key taken along line 5-5 of FIG. 4.

FIG. 6 is a side view of the key taken along line 6-6 of FIG. 4.

DETAILED DESCRIPTION

Figure 1A:
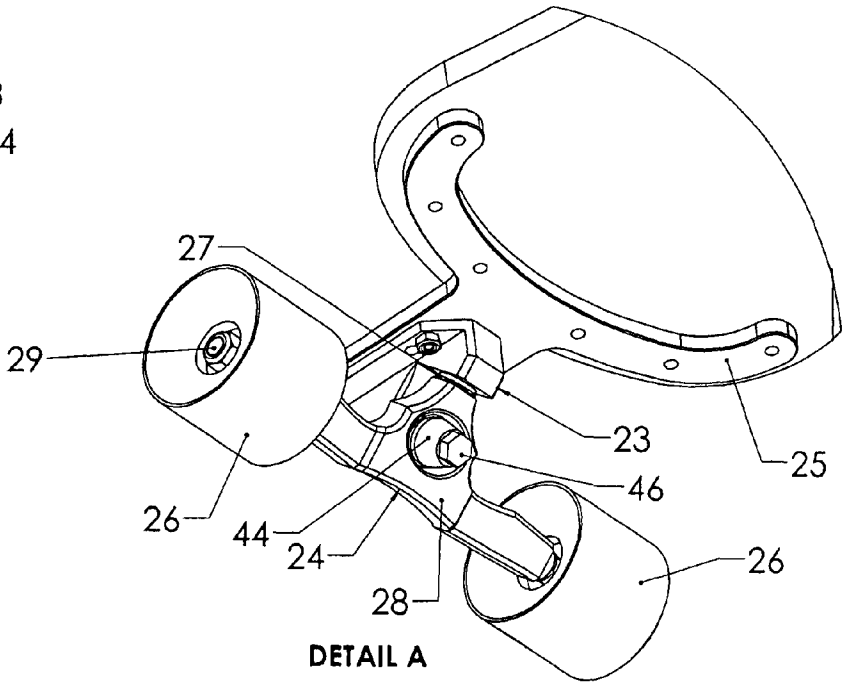
FIG. 1A is an enlarged view of the circled portion of FIG. 1.
Figure 2:
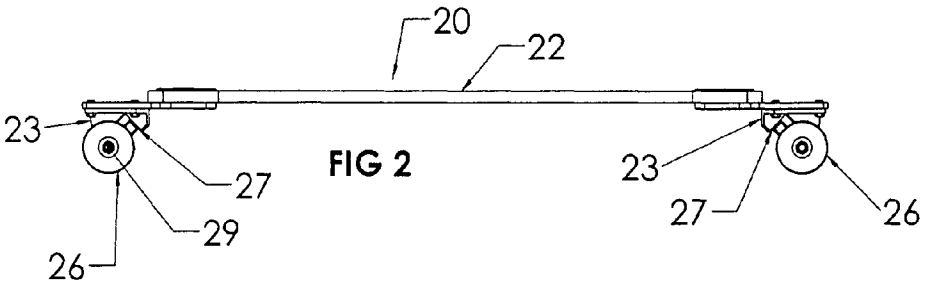
FIG. 2 is a side view of the skateboard shown in FIG. 1 showing the trucks with the wheels attached.
Figure 1:
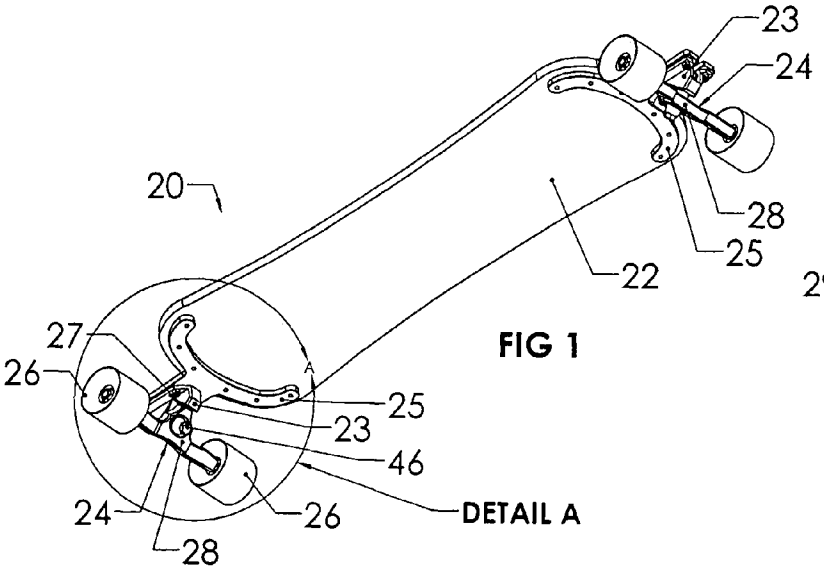
FIG. 1 is a perspective view of the underside of a skateboard showing trucks according to the present invention.
Figure 3A:
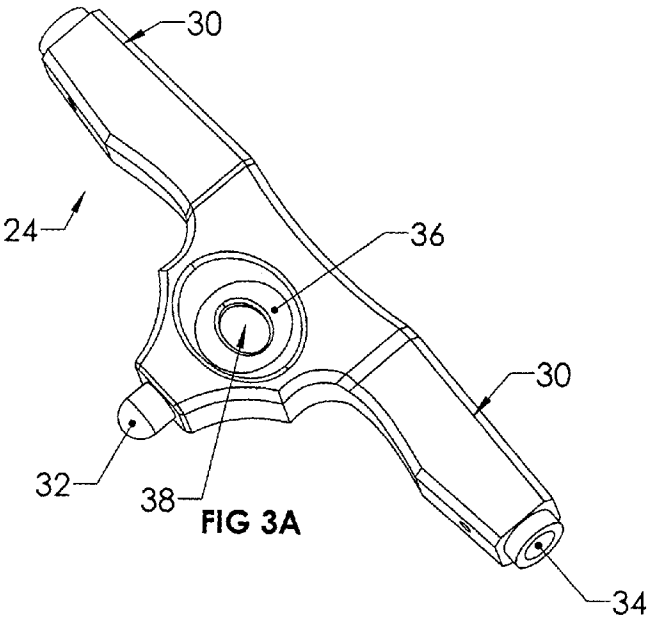
FIG. 3A is a perspective view of an exemplary embodiment of a hanger according to the present invention.
Figure 3B:
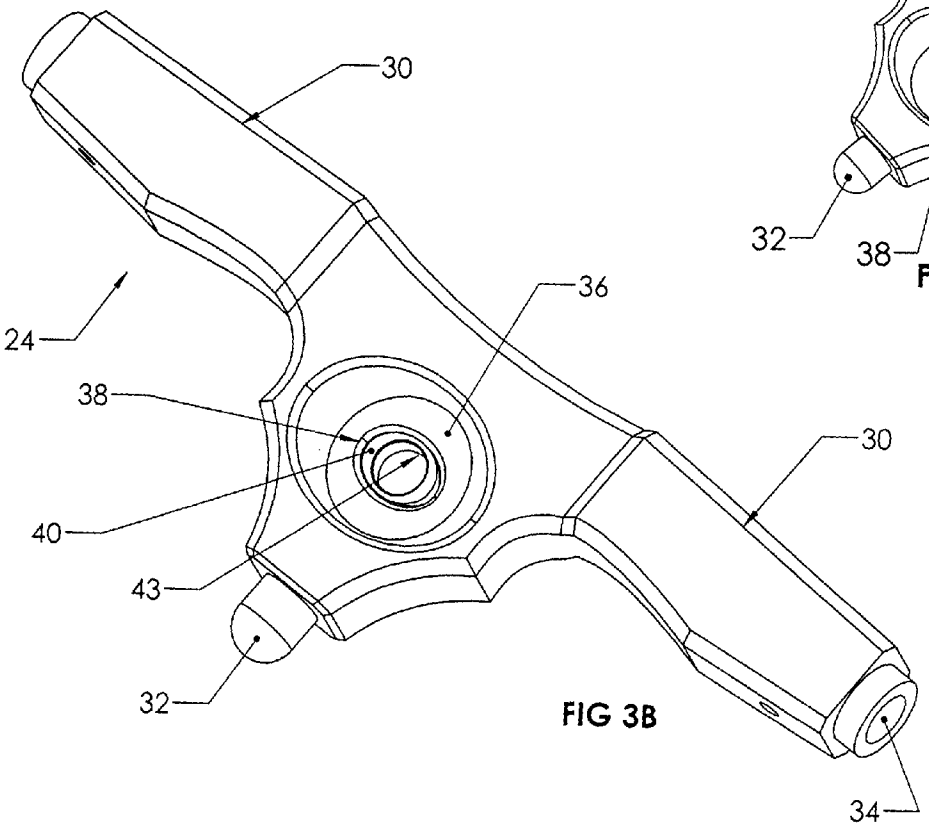
FIG. 3B is a perspective view of the hanger as shown in FIG. 3A with the key placed within the key cavity of the hanger.
Figure 9:
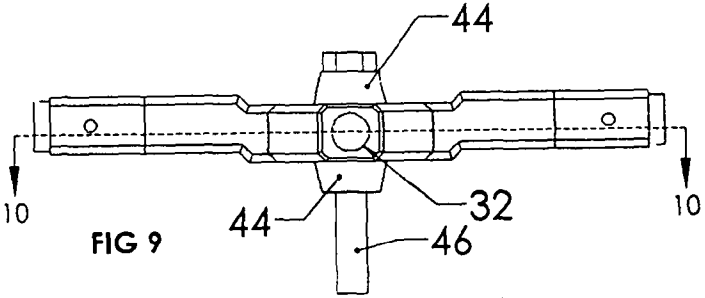
FIG. 9 is a side view of the truck as assembled taken along line 9-9 of FIG. 7.
Figure 10:
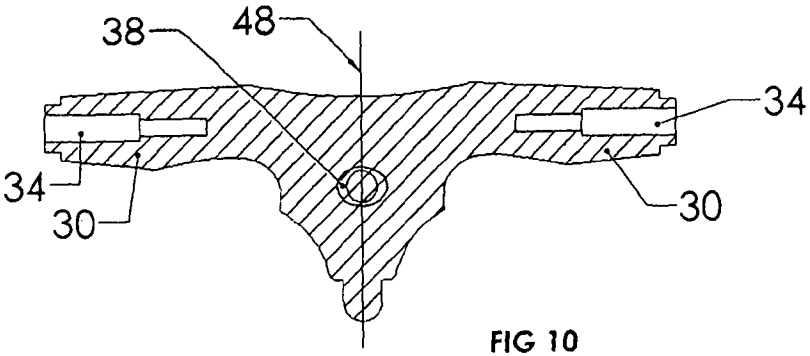
FIG. 10 is a cross-sectional view of the truck taken along line 10-10 of FIG. 9.

FIGS. 1 and 1A illustrate a skateboard 20 as seen from the underside. The skateboard has a deck 22 to which is attached a pair of baseplates 23 via support members 25. Each truck 24 includes a hanger 28 to which are attached a pair of wheels 26 (with bearings) via axles 29. Each hanger 28 is secured to the baseplate 23 by a kingpin 46. The trucks 24 allow the wheels 26 to be moved to various positions depending upon the weight applied to the upperside of the deck 22 thereby allowing the skateboard 20 to be steered by its user. As seen in FIGS. 3A, 3B, and 7-10, the truck 24 includes the hanger 28 whose details are shown in FIGS. 3A and 3B, including arms 30 and a pivot pin section 32 that fits within a pivot cap 27 of the baseplate 23. The arms 30 as seen in FIGS. 9 and 10 have recesses 34 formed therein for receipt of axles 29 upon which the wheels 26 are attached.

Figure 7:
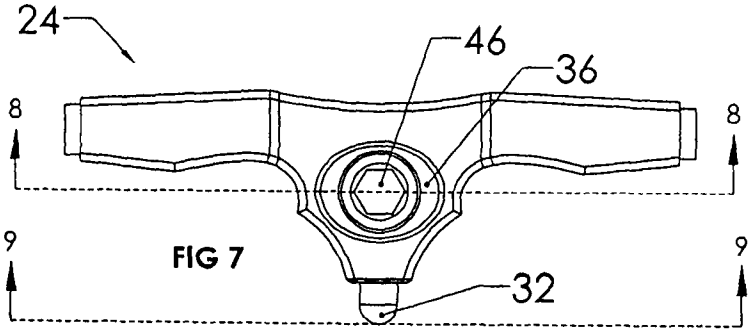
FIG. 7 is a top view of the truck showing it in its assembled position with the hanger, bushings, kingpin, and key.
Figure 8:
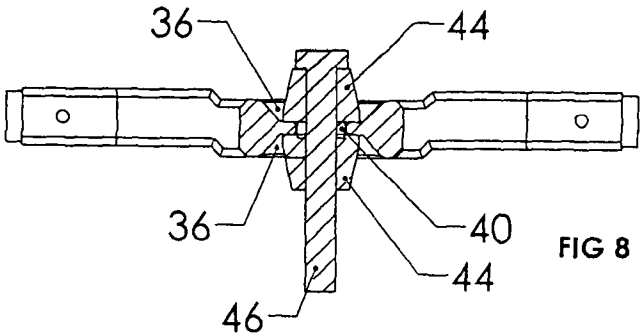
FIG. 8 is a cross-sectional view of the truck as shown in FIG. 6 taken along line 8-8 of FIG. 7.
Figure 11A:
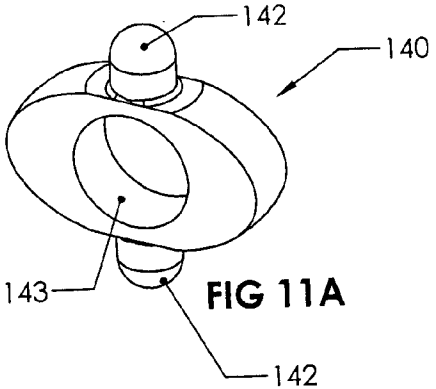
FIG. 11A is a perspective view of the key shown in FIG. 11.
Figure 11:
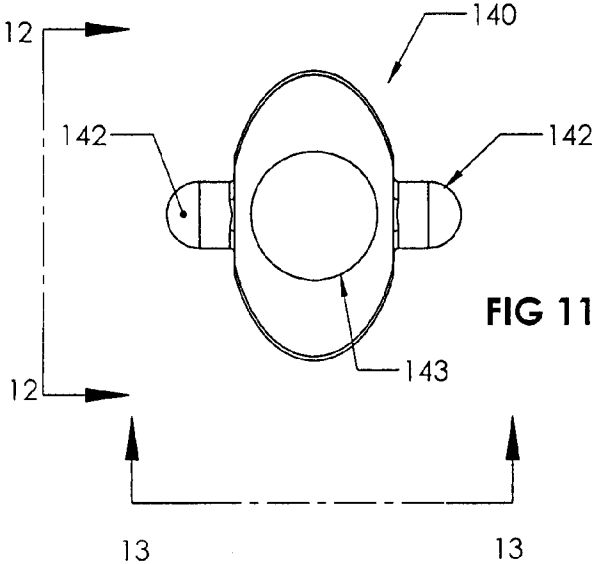
FIG. 11 is a plan view of an exemplary embodiment of a key according to the present invention.
Figure 13:
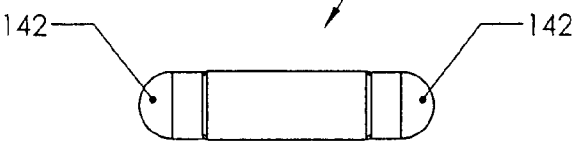
FIG. 13 is a side view of the key taken along line 13-13 of FIG. 11.
Figure 12:
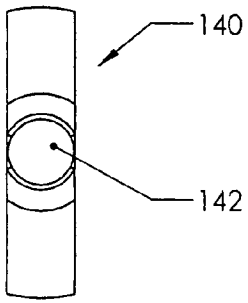
FIG. 12 is a side view of the key taken along line 12-12 of FIG. 11.

As seen in FIGS. 3A, 3B, 7, 8, and 10, the hanger 28 includes a cutout portion 36 with a key cavity 38. The cutout portion 36 is dimensioned for receipt of bushings 44 while key cavity 38 is dimensioned for receipt of a key 40 as best seen in FIGS. 3A, 3B, 4, 5, and 6. The key 40 may include a pair of protruding cylindrical shaped tabs (not shown). As seen in FIGS. 7, 8, and 9, when the key 40 is installed, it is held in place by the pair of bushings 44 which in turn are secured by a kingpin 46 passing through a central bore 43 of key 40.

When so assembled, the truck 24 allows for pivoting along center line 48 (see FIG. 10) in a manner such that the key 40 provides for free swiveling without the use or need of bearings as found in prior art devices. Off-axis movement of the hanger 28 is thereby greatly minimized.

An exemplary embodiment of the present invention thereby provides an improved truck 24 in which the hanger 28, key 40, kingpin 46, and bushings 44 all interact to provide better stability and maneuverability of the trucks 24 when the skateboard 20 is in use. In particular, the key 40 fits within the key cavity 38 of the cutout portion 36 of the hanger 28 and provides support for the bushings 44 so that it helps the hanger 28, kingpin 46 and bushing 44 assembly to snap back to their normal center-lined 48 position when the skateboard 20 is in a neutral position (weight not positioned on one edge or the other of the skateboard deck 22). The overall result is that the skateboard 20 has greater stability and greater interaction, because the bushings 44 and kingpin 46 are allowed to have what is termed a more carving/turning ability with regard to a leaning ride.

The key 40 positioned within the key cavity 38 of cutout region 36 of the hanger 28 according to the present invention is thin in cross-section (see FIGS. 4A, 5, and 6) and is flat (see FIGS. 4-6) so that it supports the bottom and top of the bushings 44 and also minimizes any off angle movement (slop movement) in the kingpin 46. The key 40 according to the present invention thereby provides the ability to interact with all of the remaining parts of the hanger 28 so as to provide a smooth swivel movement of the truck 24; thereby allowing the bushings 44 to perform and interact more quickly than those found in prior art trucks.

Figure 14:
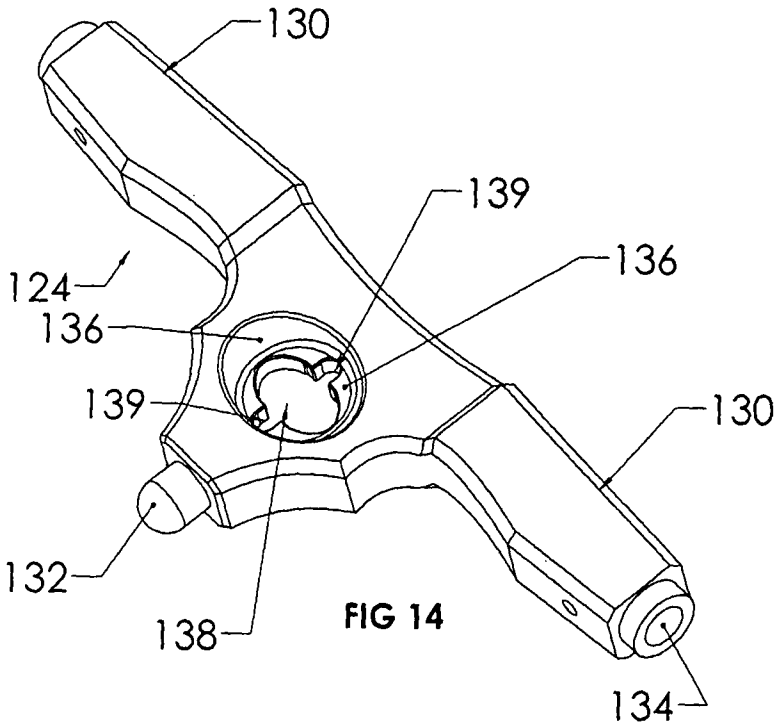
FIG. 14 is a perspective view of an exemplary embodiment of a hanger according to the present invention.

Another exemplary embodiment of a truck according to the present invention is shown in FIG. 14. The truck 124 includes a hanger 128 including a cutout portion 136 with a key cavity 138. The truck may also include a pair of arms 130 with recesses 134 formed therein for receipt of axles upon which wheels are attached. The truck may also include a pivot pin section 132. The key cavity 138 of the cutout portion 136 includes a pair of semi-cylindrical cutout regions 139. The cutout portion 136 is dimensioned for receipt of bushings (not shown) while key cavity 138 (including semi-cylindrical cutout regions 139) is dimensioned for receipt of a key 140 as shown FIGS. 11, 11A, 12, and 13. The key 140 includes a pair of protruding cylindrical shaped tabs 142 dimensioned for receipt within the semi-cylindrical cutout regions 139. When the key 140 is installed, it is held in place by a pair of bushings (not shown) which in turn are secured by a kingpin (not shown) passing through a central bore 143 of key 140 in a similar manner as that discussed above with the exemplary embodiment of the invention shown in FIGS. 7-9.

The hanger and key of the present invention can be fabricated from many different materials, such as steel, aluminum, other metallic materials or non-metallic materials that are relatively strong, such as acrylonitrile butadiene styrene (ABS) plastic or the like. The end result is a truck which allows for steering movement in a manner which minimizes off-angle movement relative to the kingpin. The functionality is obtained by the hanger having a cutout portion positioned along the center line of the hanger having a key cavity with semi-cylindrical cutout regions formed therein dimensioned for receipt of cylindrical tabs of a key which is also housed within the key cavity of the hanger. The present invention is particularly suited for long board type skateboards.

While there have been shown and described and pointed out fundamental novel features of the invention as applied to preferred embodiments thereof, it will be understood that various omissions and substitutions and changes in the form and details of the devices and methods described may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice.

What is claimed is:

1. A truck configured for attachment to a skateboard, comprising:

a hanger having a centerline that bisects the hanger, and a pair of arms extending from the hanger and positioned on opposite sides of the centerline that bisects the hanger, wherein the hanger comprises a first cutout portion on a first side of the hanger, and a second cutout portion on a second side of the hanger, and wherein the first cutout portion and the second cutout portion each comprise a base, a sidewall extending from the base and an opening defined by the sidewall;

wherein the truck further comprises:

a key cavity extending through the hanger from the first cutout portion to the second cutout portion, and a key positioned at least partially within the key cavity, wherein the key comprises a first face, a second face and a central bore passing through the key from the first face to the second face, and wherein the key is positioned between the openings of each of the first cutout portion and the second cutout portion; and wherein the key is configured to permit the truck to pivot on the centerline that bisects the hanger.

2. The truck according to claim 1, further comprising a first bushing positioned at least partially within the first cutout portion, and a second bushing positioned at least partially within the second cutout portion.

3. The truck according to claim 2, further comprising a kingpin dimensioned to pass through the central bore of the key, and operatively coupled to the first bushing, the key and the second bushing, and wherein the kingpin further operatively couples the truck to the skateboard.

4. The truck according to claim 2, wherein the first bushing and second bushing are positioned on opposite sides of the key so that the key is held in place by the first bushing and the second bushing.

5. The truck according to claim 3, wherein the first bushing, second bushing and key are secured to the hanger by the kingpin inserted at least through the central bore of the key.

6. The truck according to claim 1, wherein the truck further comprises a pivot pin section comprising a substantially cylindrical section extending from the hanger, and a substantially hemispherical section extending from the cylindrical section.

7. The truck according to claim 1, wherein each arm of the pair of arms comprises a bore forming a cavity, and the truck further comprises an axle operatively coupled to a wheel, and inserted into the cavity of each arm.

8. The truck according to claim 1, wherein the key comprises at least one cylindrical shaped tab, and wherein the key cavity comprises at least one semi-cylindrical cutout region dimensioned for receipt of the at least one cylindrical shaped tab of the key.

9. A skateboard, comprising:

a deck;

a pair of baseplates;

a pair of support members attached to an underside of the deck and to a corresponding one of the baseplates; and a truck operatively coupled to each one of the baseplates;

wherein the truck comprises:

a hanger having a centerline that bisects the hanger, and comprising a first cutout portion on a first side of the hanger, and a second cutout portion on a second side of the hanger, wherein the first cutout portion and the second cutout portion each comprise a base, a sidewall extending from the base and an opening defined by the sidewall, a pair of arms extending from the hanger and positioned on opposite sides of the centerline that bisects the hanger, a key cavity extending through the hanger from the first cutout portion to the second cutout portion, and a key positioned at least partially within the key cavity, wherein the key comprises a first face, a second face and a central bore passing through the key from the first face to the second face, and wherein the key is positioned between the openings of each of the first cutout portion and the second cutout portion; and wherein the key is configured to permit the truck to pivot on the centerline that bisects the hanger.

10. The skateboard according to claim 9, further comprising a first bushing positioned at least partially within the first cutout portion, and a second bushing positioned at least partially within the second cutout portion.

11. The skateboard according to claim 10, further comprising a kingpin dimensioned to pass through the central bore of the key, and operatively coupled to the first bushing, the key and the second bushing, and wherein the kingpin further operatively couples the truck to the skateboard.

12. The truck according to claim 10, wherein the first bushing and second bushing are positioned on opposite sides of the key so that the key is held in place by the first bushing and the second bushing.

* * * * *